US006888326B2

(12) United States Patent
Amaldi et al.

(10) Patent No.: US 6,888,326 B2
(45) Date of Patent: May 3, 2005

(54) LINAC FOR ION BEAM ACCELERATION

(75) Inventors: Ugo Amaldi, Geneva (CH); Massimo Crescenti, Geneva (CH); Riccardo Zennaro, Versoix (CH)

(73) Assignee: Fondazione per Adroterapia Oncologica—TERA, Novara (IT)

( * ) Notice: Subject to any disclaimer, the term of this patent is extended or adjusted under 35 U.S.C. 154(b) by 0 days.

(21) Appl. No.: 10/602,060

(22) Filed: Jun. 24, 2003

(65) Prior Publication Data

US 2004/0108823 A1 Jun. 10, 2004

(30) Foreign Application Priority Data

Dec. 9, 2002 (IT) ..... MI2002A2608

(51) Int. Cl.[7] ..... H05H 9/00

(52) U.S. Cl. ..... 315/505; 315/5.42; 315/5.43; 313/359.1; 313/361.1

(58) Field of Search ..... 315/500–506, 315/5.41–5.43; 313/359.1, 361.1; 250/423 R, 424, 423 F, 396 R, 492.3

(56) References Cited

U.S. PATENT DOCUMENTS

| | | | | |
|---|---|---|---|---|
| 3,403,346 A | * | 9/1968 | Giordano | 315/505 |
| 4,712,042 A | * | 12/1987 | Hamm | 315/5.41 |
| 4,906,896 A | | 3/1990 | Swenson | 315/5.41 |
| 5,113,141 A | | 5/1992 | Swenson | 315/505 |
| 5,382,914 A | | 1/1995 | Hamm et al. | 315/505 |
| 5,523,659 A | | 6/1996 | Swenson | 315/506 |
| 5,801,488 A | * | 9/1998 | Fujisawa | 315/5.41 |
| 5,825,140 A | * | 10/1998 | Fujisawa | 315/505 |

FOREIGN PATENT DOCUMENTS

GB 1 311 616 3/1973

OTHER PUBLICATIONS

Chen, Z.: "Bridge coupler thermal/structural analysis and frequency shift studies for the coupled cavity linear acclerator of the Spallation Neutron Source" 2001, Piscataway, NJ, IEEE, USA, 2001, pp. 897–899 vol. 2.

Harvey, A. et al.: "Designs of the low energy intertank quadrupole magnets for APT" Particle Accelerator Conference, 1999 Proceedings of the 1999 New York, NY Mar. 27–Apr. 2, 1999, Piscataway, NJ, USA, IEEE, US, Mar. 27, 1999, pp. 3576–3578.

Ratzinger, U. et al.: "Status of the HIIF RF linac study based on H–mode cavaities" Nucl. Instrum. Methods Phys. Res. A, Accel. Spectrom. Detect. Assoc. Equip. (Netherlands), Nuclear Instruments & Methods in Physics Research, Section A (Accelerators, Spectrometers, Detectors and Associated Equipment), Sep. 21, 1998, Elsevier, Nether, vol. 415, No. 1–2, 1998, pp. 229–235.

Takeda, H.: "A compact high–power proton linac for radioisotope production" Particle Accelerator Conference, 1995, Proceedings of the 1995 Dallas, TX, USA May 1–5, 1995, New York, NY, USA, IEEE, US, May 1, 1995, pp. 1140–1142.

* cited by examiner

*Primary Examiner*—Haissa Philogene
(74) *Attorney, Agent, or Firm*—Young & Thompson

(57) ABSTRACT

A drift tube linear accelerator (linac) that can be used for the acceleration of low energy ion beams. The particles enter the linac at low energy and are accelerated and focused along a straight line in a plurality of resonant accelerating structures interposed by coupling structures up to the desired energy. In the accelerating structures, excited by an H-type resonant electromagnetic field, a plurality of accelerating gaps is provided between drift tubes supported by stems, for instance alternatively horizontally and vertically disposed. A basic module composed of two accelerating structures and an interposed coupling structure, or a modified coupling structure connected to a RF power generator, is if necessary linked to a vacuum system and equipped with one or more quadrupoles.

12 Claims, 7 Drawing Sheets

LINAC FOR ION BEAM ACCELERATION

FIELD OF THE INVENTION

The present invention relates to a drift tube linear accelerator (linac) for accelerating ions as a beam, a system comprising such a linac and a method for accelerating an ion beam according to the preambles of claims 1, 8 and 11, respectively. The invention also relates to the application fields of the disclosed linac, system and accelerating method.

BACKGROUND OF THE INVENTION

It is well known that particle accelerators are used to accelerate ions (protons and heavier ions) to very high velocities. At high velocities, a large number of such particles form what is called a "beam", and this beam can be used for different purposes, for instance research, medical or industrial applications. Early accelerators' cost and size practically limited the utilisation thereof to research laboratories. Even today, the existing accelerators are often unpractical for many applications making use of ions.

Existing accelerators are of three kinds: cyclotrons, linacs and synchrotrons.

If the request is for ion beams of large mass-over-charge ratio and/or for the velocity range up to about 0.6 times that of light, conventional cyclotrons are less suited. Compactness, modularity, less complexity and as a result lower cost are the advantages of linacs with respect to synchrotrons.

The technology of radio frequency (RF) linacs is currently used for the acceleration of charged particles from an "ion source" to the desired energy. For ions (protons and heavier ions), the energy range covered by linacs is of several tens of kilo-electron-volts per nucleon (keV/u) to hundreds of million-electron-volts per nucleon (MeV/u), i.e. a velocity range from about 0.05 to about 0.9 times that of light. Several types of linacs, which are maximally efficient in a particular energy sub-range, have been developed. If a large range has to be covered, different linac structures, each optimally chosen in its frequency range, are serially disposed, with a consequent increased complexity and cost of the whole system.

All linac designs generally consist of evacuated cylindrical type metallic cavities or transmission lines. These structures are filled with electromagnetic energy by RF power generators. The beam passes through the longitudinal axis of the linac and encounters strong RF electric fields that can accelerate the charged particles, if the phase of the RF wave is appropriately synchronised with the arrival of the bunched beam.

To date, two kinds of structures have been used: travelling wave and standing wave structures. In travelling wave structures, the accelerator is a transmission line and behaves like a waveguide in which the electromagnetic waves travel along the whole length of the structure. Some power is delivered to the beam, some power is lost due to ohmic losses and the rest is dumped in a matched load. In standing wave structures, the accelerator is a resonant cavity inside which the injected electromagnetic waves establish a time-dependent standing wave pattern, periodic at the resonant frequency.

It is well known that a parameter commonly employed in this field is $\beta=v/c$, where v is the velocity of the particles and c is the velocity of light. Standing wave linacs are mainly used for particle velocities less than half the speed of light (low $\beta$ linacs). Both standing wave and travelling wave linacs are used for higher velocities (medium $\beta$ linacs), with the current trend in favour of the first solution. At $v \approx c$, travelling wave linacs predominate (high $\beta$ linacs). It is also known that deep cancer therapy with light ion beams requires $\beta \leqq 0.6$, which is in the range of standing wave linacs.

Moreover, it is known that:

- in the low velocity range ($0.01 \leqq \beta < 0.1$), the most commonly used linac structure is the Radio-Frequency Quadrupole (RFQ),
- in the middle velocity range ($0.1 \leqq \beta \leqq 0.4$), the most used is the Drift Tube Linac (DTL) structure,
- the Coupled Cavity Linac (CCL) structure is the standing wave structure most used in the high velocity range ($0.4 \leqq \beta < 1$).

In standing wave linacs, the RF electric fields are applied inside evacuated resonant cavities to a linear array of electrodes. The spacing between the electrodes is arranged so that the field in an appropriate phase with respect to the beam arrival delivers "useful" power to the particles. The rest of the time, the field is shielded and does not act on the bunched beam. The spacing between successive electrodes also takes into account the increase in particle velocity, leading to longer structures for higher velocity beams.

The RF electric fields in these cavities result from the excitation of resonant electromagnetic cavity modes. Normally, the field pattern is contained in a cylindrical volume. In such a volume, two family modes can exist:

- transverse magnetic modes (TM), also called E-modes, where a strong electric field component exists along the beam direction (or, in other words, the magnetic field is transversal to the beam direction),
- transverse electric modes (TE), also called H-modes, where a strong magnetic field component exists along the beam direction (or, in other words, the electric field is transversal to the beam direction). In this latter family, the insertion of the electrodes modifies the field pattern from the just exposed configuration, in such a way that a strong electric field component is always directed along the beam direction, which is the useful direction.

Experience in cavities development with both types of standing wave patterns has led to understand the different behaviour of cavities using E-modes or H-modes.

In E-mode families, the insertion of the electrodes does not affect very much the direction of the accelerating field, which is already directed along the beam direction.

On the contrary, in H-mode families, the insertion of the electrodes drastically re-directs the accelerating field along the beam axis. As a result, in H-mode cavities, the electric field is better concentrated close to the beam axis, where it is effectively needed. Therefore, H-mode structures are more efficient.

A parameter commonly used to measure the efficiency of the cavity with respect to power consumption is the "shunt impedance per unit length". This parameter has the dimensions of a resistance per unit length and is independent on the field level and on particle velocity.

Generally speaking, H-mode cavities have quite large effective shunt impedance per unit length, decreasing when the particle velocity increases, while E-mode cavities have the opposite behaviour. Therefore H-mode cavities are more efficient at low velocity, while E-mode cavities are better at high velocity, the crossover usually being placed at around $\beta \approx 0.4$.

The longitudinal dimensions of the accelerating structure are linked to the length travelled by the particles in an RF period, also called the "particle wavelength" or $\beta\lambda$, where $\lambda$ is the RF wavelength. Efficient acceleration occurs when the particles arrive at each accelerating gap with the appropriate RF phase. In an RF linac, two working modes are possible: 0-mode and $\pi$-mode. Considering the RF field at a given time, in 0-mode the on-axis accelerating field has the same module and sign at each accelerating gap, while in $\pi$-mode the electric field changes sign from one gap to the next. The current trend is in favour of the $\pi$-mode, since, for the same $\beta\lambda$ the effective average field gradient is higher.

A more detailed description of the particle accelerators used to date can be found in the references at the end of this description, listed by publication date.

Finally, it must be pointed out that the field of application has a major impact on the choice between the existing types of proton and ion accelerators of different structural characteristics and functionalities:

- in radiotherapy, the requirement is for extremely precise, very low intensity pencil beams of limited energy and small energy spread. Preferably, they have to be delivered by reasonably small and compact structures to be installed in the limited space available in a hospital environment, while
- in the field of research, the requirement is often for high intensity and high-energy beams for experiments, for instance in high energy physics, or related to nuclear fission, fusion and many other applications.

U.S. Pat. No. 5,382,914 discloses a linac for proton therapy, the structure of which is rather conventional and the DTL practically represents the well-known Alvarez structure. The 0-mode is used for acceleration in the DTL linac and the latter is considerably long.

U.S. Pat. No. 5,523,659 relates to a radio frequency focused DTL having a known Alvarez structure with modifications including RF focusing sections of the RFQ type. The mechanical construction including the electric focusing is complex. The resulting shunt impedance is low and the resulting coupling between longitudinal and transverse planes complicates the beam transport.

U.S. Pat. No. 5,113,141 discloses a four-fingers RFQ linac structure, which is a H-mode cavity structure, making the attempt to focus and accelerate at the same time low energy beams. The efficiency of this kind of focusing rapidly decreases as $\beta$ increases. The resulting shunt impedance is low and the resulting coupling between longitudinal and transverse planes complicates the beam transport.

U.S. Pat. No. 4,906,896 relates to a disk and washer linac the structure of which makes use of E-modes. At low $\beta$ the shunt impedance is low. The mechanical construction is complicated. The field stability is rather low since it is perturbed by RF resonances close to the working mode.

SUMMARY OF THE INVENTION

Accordingly, the main object of the present invention is to provide a new ion beam accelerator, a system containing such an accelerator and also a method for accelerating ion beams able to satisfy the above-mentioned requirements. Another object of the present invention is to use some new as well as some existing components, but exploiting new single and combined functionalities in order that, together, unexpected and surprisingly good results are produced, allowing, among other advantages, an effective reduction in the overall dimensions of the accelerator, which can easily be installed in a clinic or an hospital.

Still another object of the present invention lies in the proposed modularity, which makes it possible on one hand to produce the ion beam of the required energy, and, on the other hand, to reduce the number of components needed in conventional linacs, thus reducing construction and operational costs.

An additional object is to be seen in the fact of obtaining high stability for the accelerating field, irrespective of the frequency and length of the resonating structure.

Another object of the present invention is the increase of the accelerating gradient, and, as a consequence, the considerable reduction of the accelerator length.

Yet another object of this invention is the consistent reduction in electric power consumption, thus reducing the operational cost of the accelerator, or of the structure or of the overall system including the present invention.

Still another object of the present invention is the increase of the velocity range up to at least $\beta \approx 0.6$ within small dimensions, thus allowing, in case of medical applications, deep cancer therapy.

Another object of the present invention is the possibility, with the proposed linac, to work also at low frequencies, for instance in the range of about 100 MHz to about 0.8 GHz for high current production for research or other practical applications.

These and other objects and advantages are obtained with a drift tube linac, a system containing such a linac and a method for accelerating the ion beam having the characteristics exposed in claims 1, 8 and 11, respectively.

BRIEF DESCRIPTION OF THE DRAWINGS

Further characteristics, advantages and details of a linac in accordance with the present invention, a system containing such a linac, as well as a ion beam accelerating method in accordance with the present invention will become more apparent from the following disclosure with reference to the accompanying drawings showing preferred inventive embodiments, which are given by way of indicative examples only.

In the drawings.

DETAILED DESCRIPTION OF THE PREFERRED EMBODIMENT

Figure 1:
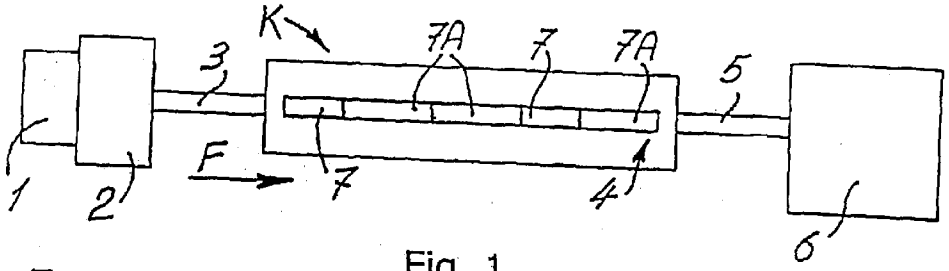
FIG. 1 is a block diagram of a complete system comprising a linac in accordance with the present invention.

In the different figures, the same reference number always refers to the same element. Only the parts necessary for the comprehension of the invention have been illustrated. In the following structural, functional and method description, we refer firstly to FIG. 1, which shows a block diagram of a system or a complete complex K comprising a linac developed according to the present invention and indicated as a whole with 4.

A conventional ion source 1 injects a collimated ion beam into a conventional "injector" 2, for instance an electrostatic accelerator, or a small cyclotron, or an RFQ. The arrow F indicates the beam direction. The pre-accelerated beam is then injected into a conventional low energy beam transport section (LEBT) 3, which focuses and steers the beam up to the entry of the accelerator or linac 4 according to the invention. Said linac 4 is a kind of Drift Tube Linac (DTL), working at high frequency, for instance for cancer therapy applications. Said linac 4 is composed of one or more base modules 7 and/or one or more enlarged modules 7A, described in detail below, and is called Coupled-cavity Linac USing Transverse Electric Radial fields (CLUSTER). As mentioned before, the accelerating resonant structures 8 are excited, according to the invention, on a H-mode standing wave electromagnetic field pattern, with high working frequency, for instance for cancer therapy. As will be shown and described in more detail below, several accelerating structures 8 are aligned and coupled together on a modular basis, in order to obtain the required output energy for the CLUSTER 4, foreseen for the beam application. Said output beam energy can be modulated by varying the incoming RF power, whereas the output beam intensity can be modulated by adjusting the ion beam injection parameters and dynamics.

It should be pointed out that conventional H-type cavities are currently used for the acceleration of low velocity, high intensity and high mass-over-charge ion beams. In such applications, the beam transverse dimensions are rather high (some tens of mm), and therefore the beam hole must also be correspondingly large, at least some tens of mm, a factor ⅔ is normally accepted between beam diameter and beam hole. As a consequence, the cavities built and working under known concepts are bound to work on a low frequency range, i.e. from about a few MHz (cavities with diameters of about 1 m) up to a few hundreds MHz (cavities with diameters of the order of about 0.3 m). Conversely, in medical applications, since low intensity beams are required, a beam hole of the order of a few mm is large enough.

In order to simplify the installation in hospitals, the length of such structures should be as short as possible. Instead of using mid or low working frequencies, as usually done in the conventional linacs, in the CLUSTER 4, according to the invention, the use of high working frequencies of about 0.5 GHz to several GHz, e.g. 6–7 GHz, is proposed. Today, the progress in mechanical technologies allows the production of such small structures with the required precision.

It should be also pointed out that the field stability decreases with the increase in frequency and length. This severely limits the development of long conventional accelerating structures. The present invention solves the problem by creating a sequence of accelerating cavities of moderate length coupled together, with a new coupling modality, as illustrated and explained below. With this new modality, the stability is not only maintained but is also reinforced by the coupling.

Coupled cavity systems have been proposed or designed but none has considered H-type accelerating structures. In the usual techniques H-type structures are typically used at low velocity and low frequency. As indicated before, according to the invention it is on the contrary proposed to use such H-type structures at much higher frequencies. In fact, it is well known that the higher the frequency, the higher the allowable field, with consequent increase of the energy gain per meter and reduction of the overall accelerator length. This parameter is very critical, for instance in medical applications, where the search for reduction of the overall accelerator length is linked to the reduction of costs and installation space.

However, the RF accelerating field causes a radial defocusing effect, particularly important at low energy, which limits the maximum allowable field. Therefore, a certain number of radial focusing actions must be added as well, bringing to an overall increase in the whole accelerator length.

According to the invention, the transverse focusing is obtained with a well-known technique based on the use of magnetic quadrupoles as focusing elements. The dimensions of said quadrupoles do not scale directly with the frequency. At low frequency the conventional choice is, where possible, the insertion of the quadrupoles inside the accelerating cavities, or, where not possible, the construction of separated cavities alternated by focusing elements.

At high frequency, no space can be allowed for the insertion of the quadrupoles in the accelerating cavities, and the solution of alternate accelerating structures and focusing elements leads to long and unpractical structures.

On the contrary, as proposed by the present invention, and as can be seen in the figures concerning a preferred embodiment, the focusing quadrupoles 18 can be located directly inside the coupling structures 9. In this way, the coupling structures 9 have two functionalities at the same time: coupling between two accelerating structures 8 and the housing of magnetic quadrupoles 18 for transverse beam focusing.

According to the present invention a new concept of coupling structure 9 between accelerating structures 8 is proposed. Such coupling structure 9, having a diameter of about twice the diameter of the accelerating structures 8, operates functionally like a bridge for the power flow between the structures or accelerating structures 8, and at the same time if necessary houses the quadrupoles 18, as mentioned before, and if necessary presents the connection to the vacuum system 13. Such connection can also be opened elsewhere in the module 7.

Therefore, according to the invention, a base module is composed by a middle coupling structure 9 and two accelerating side structures 8, said three structures joined together.

Figure 2:
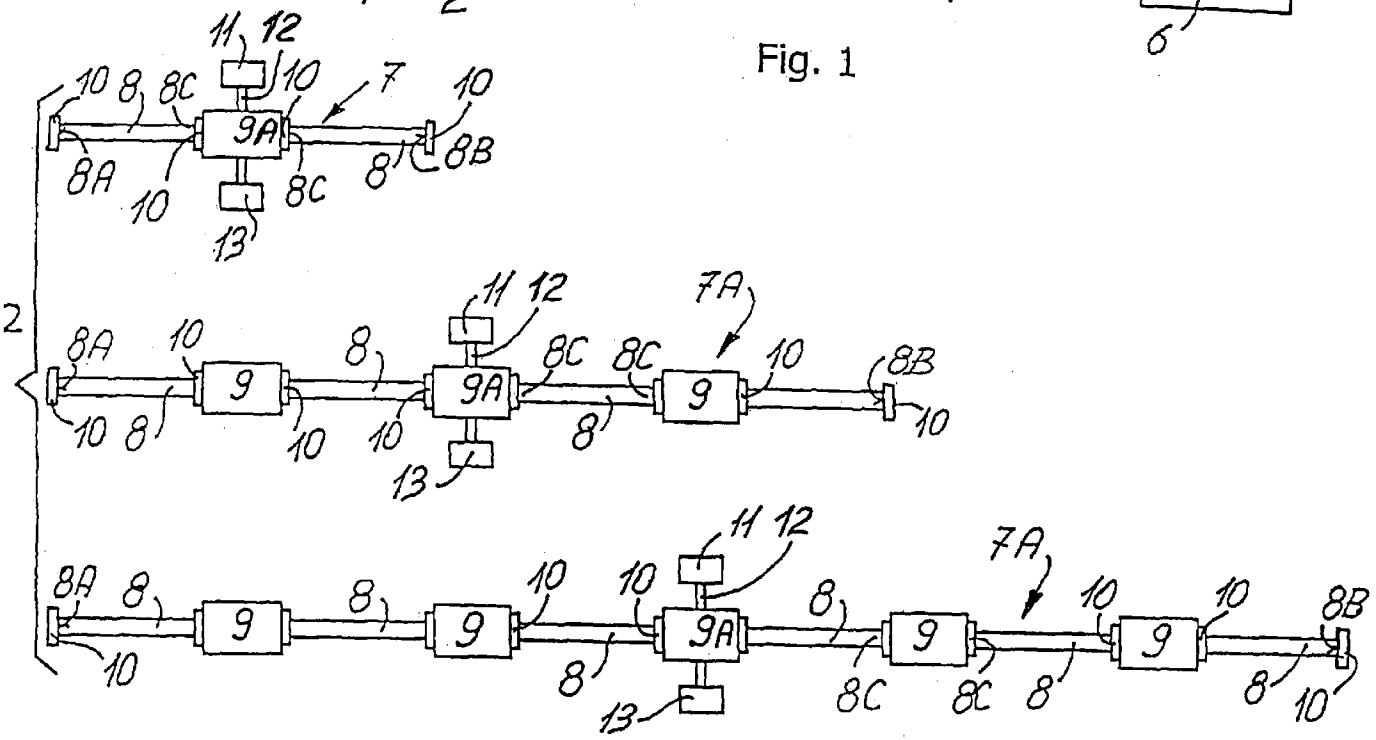
FIG. 2 shows three block diagrams respectively of a base module of a CLUSTER (denomination explained hereinafter in the detailed description of preferred embodiments) according to the invention for n=1, and of two enlarged modules with n=3 and n=5, respectively, where n indicates the odd number of coupling structures in the module.
Figure 11:
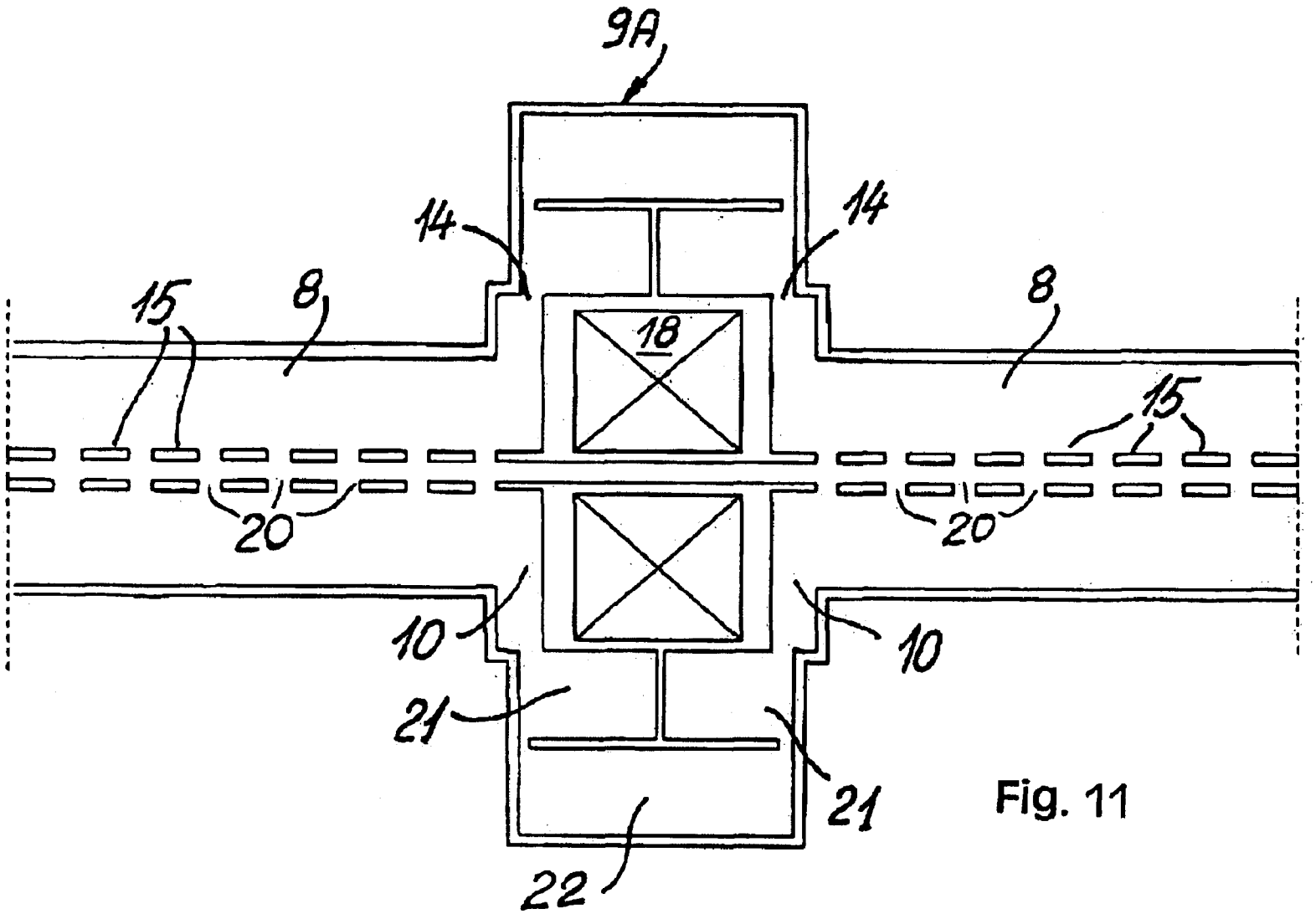
FIG. 11 is a partial longitudinal section of a module, showing a middle coupling structure modified for coupling to RF power feeder and part of two accelerating side structures, in a 45° section.

According to the invention, in the illustrated example the coupling with the RF power generator 11 is done, where necessary (e.g. in a single base module), see FIG. 2, through a modified coupling structure 9A. Said coupling structure 9A is similar to said coupling structure 9, where structure 9 is split in two parts, called split coupling cells 21, and a third cell, coaxial, called feeder. cell 22, is added. A possible, but not exclusive configuration is shown in FIG. 11, where a longitudinal 45° bent section comprising the modified coupling structure 9A at the centre and part of two accelerating structures 8 are shown. In this way the π/2 RF configuration is maintained. Now the two split coupling cells 21 are left unexcited by the field, while the feeder cell 22 is excited. Therefore the power is efficiently injected via a waveguide or a coaxial cable into the feeder cell 22 and passes through the two split coupling cells 21 via two or more slots. The length of the so modified coupling structure is such to keep the synchronism with beam acceleration.

Coupling to the RF power generator according to the invention is therefore mechanically easy to build and has the advantage to avoid any distortion of the field in the accelerating structures 8.

According to the invention, with the proposed coupling system enough space can be allocated in the central part of the coupling structure 9, 9A to insert one or more quadrupoles 18 for the transverse focusing. The space needed for the coupling structure is therefore advantageously used also for beam transverse focusing, obtaining in such way the maximum compactness of the whole CLUSTER 4.

It is pointed out here that the quadrupoles 18 could also be substituted with other functionally equivalent components, in case placed also out of the coupling structures 9,9A an that, in particular embodiments, said quadrupoles 18 could also be omitted.

With the teaching of the present invention to use high frequencies, it is also possible to achieve a reduction of power consumption. In fact, it is a general rule that, if the geometry of the structure is scaled with the frequency, the effective shunt impedance per unit length increases with the square root of the frequency.

Another teaching of the present invention consists in the combination of the previous teaching and the use of H-modes, intrinsically more efficient.

Moreover, according to the invention, in order to produce an ion beam with the required energy for the foreseen application, besides the base modules 7 also extended modules 7A are foreseen, composed by a base module 7 to which are added more coupling structures 9, 9A and more accelerating structures 8, as shown for instance in FIG. 2, where the number n of coupling structures is always an odd number and the number of accelerating structures is N=n+1.

Therefore, according to the present invention in a simple embodiment a single RF power generator 11 can power a module 7 or 7A of the CLUSTER 4, while, if several associated modules 7 and/or 7A are foreseen, also can be foreseen several single power generators 11, with a single RF output 12 or with multiple, tree-type output 12, where with 12 we define also the RF input entries in the modified coupling structures 9A of modules 7, 7A foreseen.

According to the invention each module has a single RF input 11 on a single modified coupling structure 9A.

Back to the figures, in the proposed CLUSTER 4, according to the invention, the ion beam is accelerated and longitudinally focused at the same time by RF electric fields in the accelerating gaps 20 up to the design energy for the foreseen application, for instance cancer therapy. Transverse focusing is given separately by magnetic fields. The CLUSTER output beam is then fired into a high-energy beam transport (HEBT) line 5 that focuses and steers said beam into the utilisation area 6, where it is used, for instance for medical purposes.

For medical applications it is possible to accelerate the ion beam up to about 4000 MeV (330 MeV/u), which is the present optimal maximum beam energy considered for deep cancer therapy.

Generally speaking, the number of required base modules 7 and the composition of the extended modules 7A will depend also on the working frequency, on the maximum power delivered by the RF generators, on the required field level and also on the injection energy of the pre-accelerated beam. According to the present invention, the modular preferred embodiment allows in any case to minimise the number of RF power generators in the CLUSTER 4, so to reduce as far as possible the cost of the CLUSTER 4 and as a consequence, of the whole system K including CLUSTER 4 according to the invention.

It is pointed out that the cavities in the modules, for instance the series of three 8–9, 9A-8 cavities or other series, tuned at the same working frequency, are coupled in order to resonate in the mode π/2, with the coupling cavity/ies 9 nominally unexcited or, in case of coupling cavity/ies 9A, only partly excited, where such configuration greatly contributes to the stability of the system.

Figure 3:
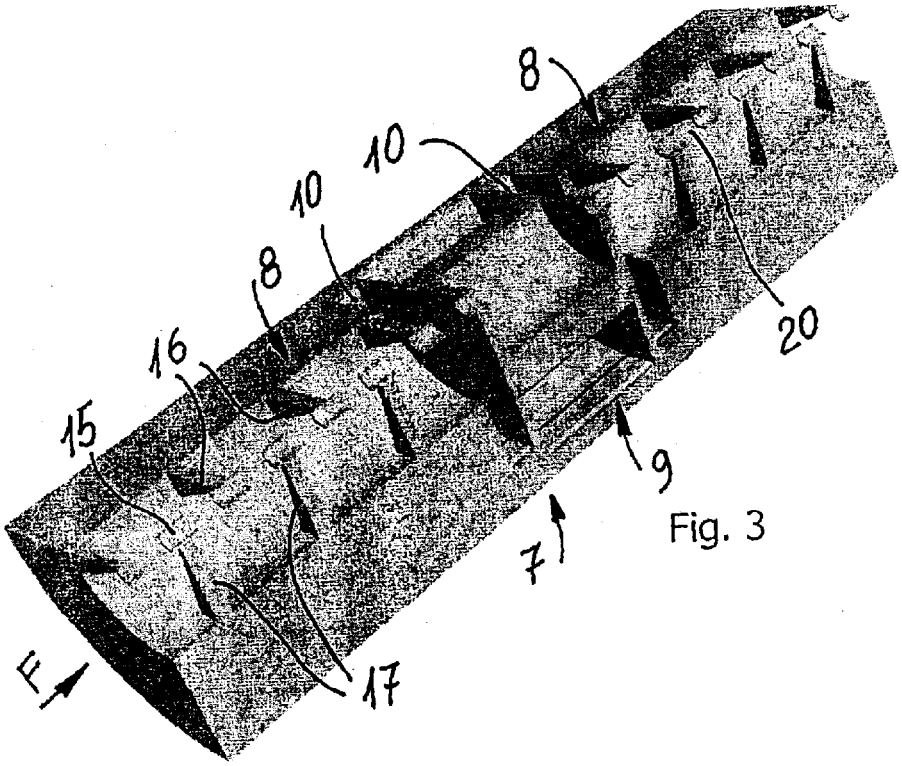
FIG. 3 is a perspective view of a longitudinal section of a quarter of the basic structure showing the inner part of two accelerating side structures, of their internal terminations, and of a middle coupling structure.

A partial tri-dimensional section of the preferred embodiment is shown in FIG. 3. From the Figure can be noticed part of two accelerating structures 8 and a coupling structure 9.

Figure 4:
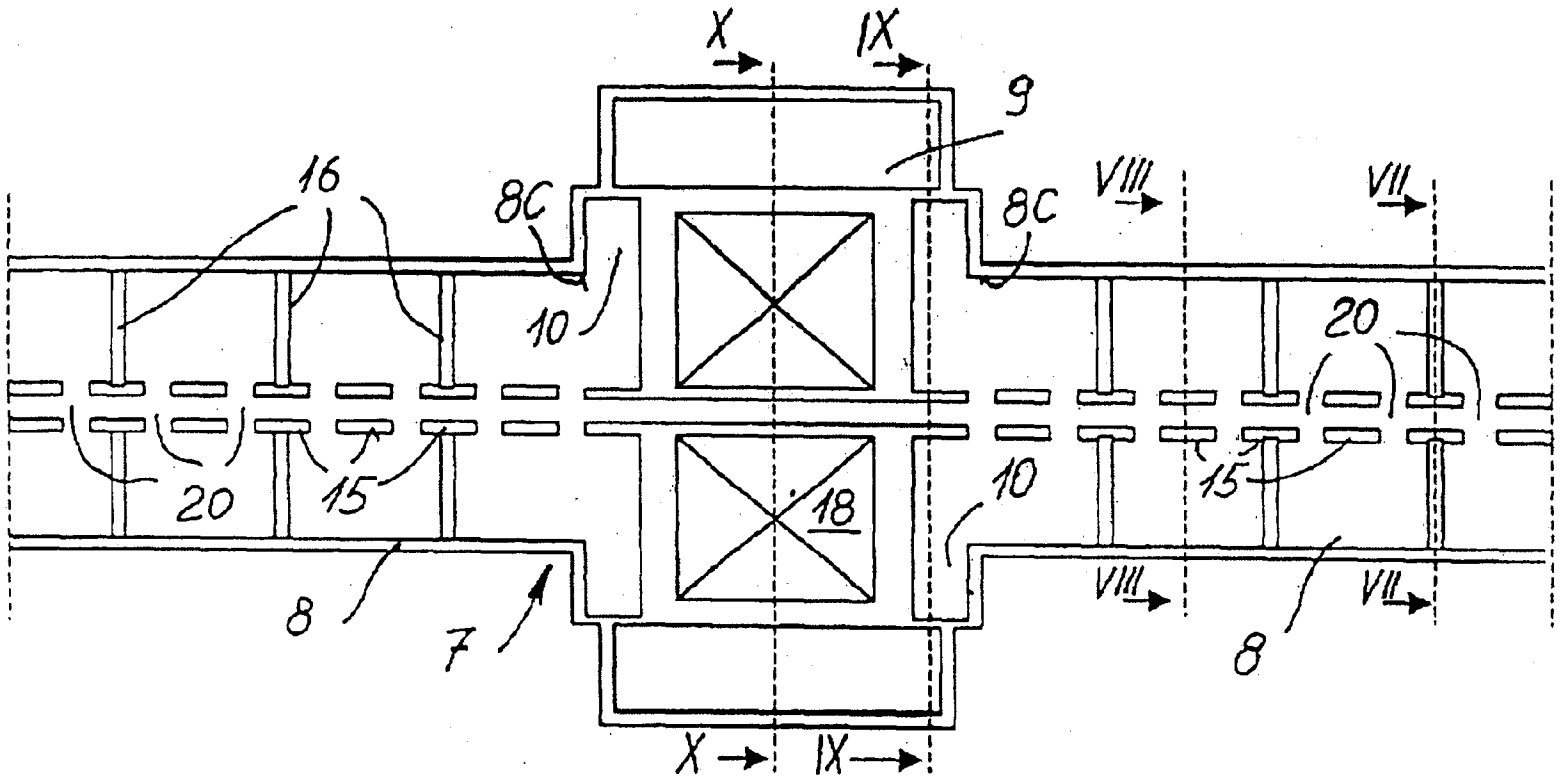
FIG. 4 is a partial horizontal longitudinal section of a module showing a middle coupling structure and part of two accelerating side structures.
Figure 5:
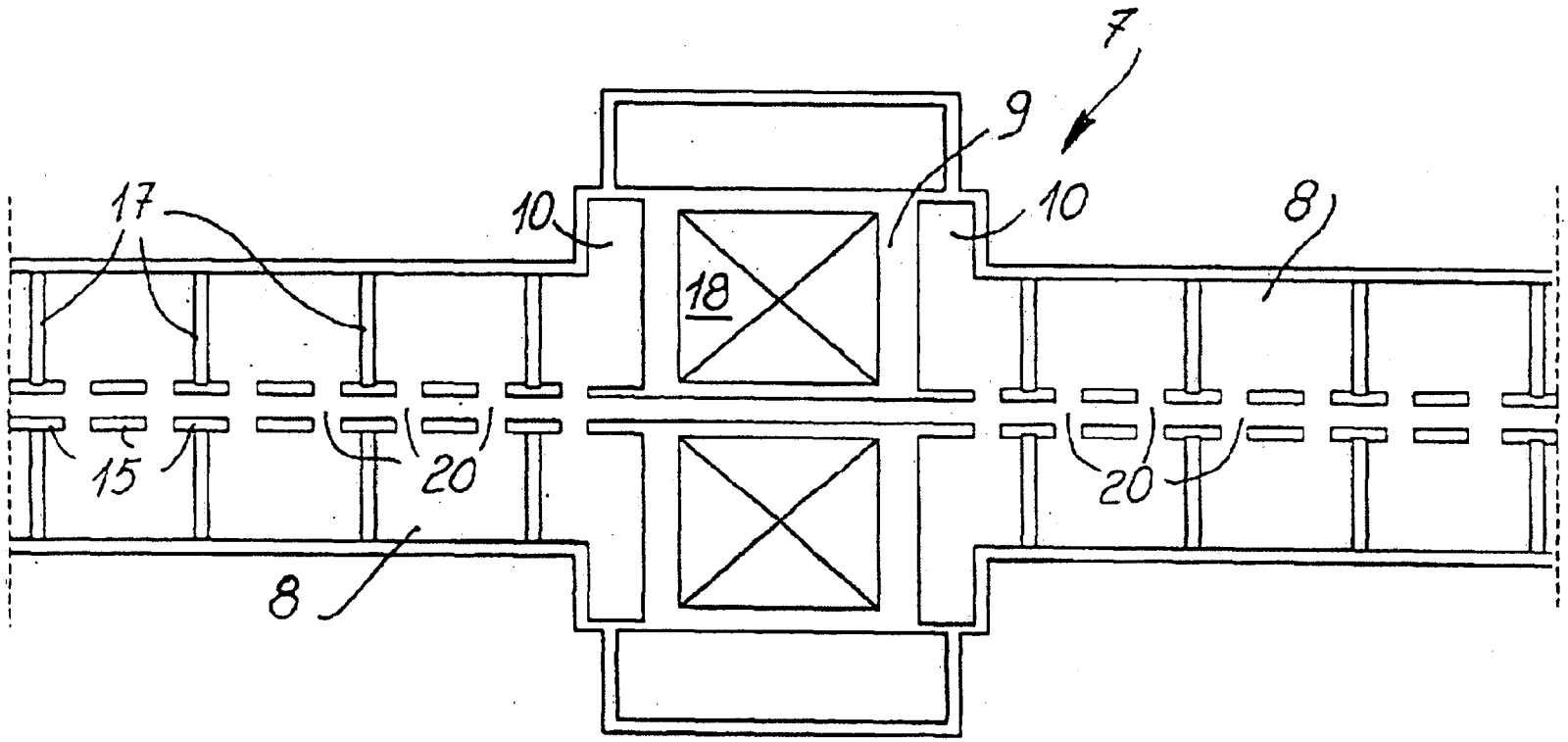
FIG. 5 is a partial vertical longitudinal section of a module, showing a middle coupling structure and part of two accelerating side structures.
Figure 6:
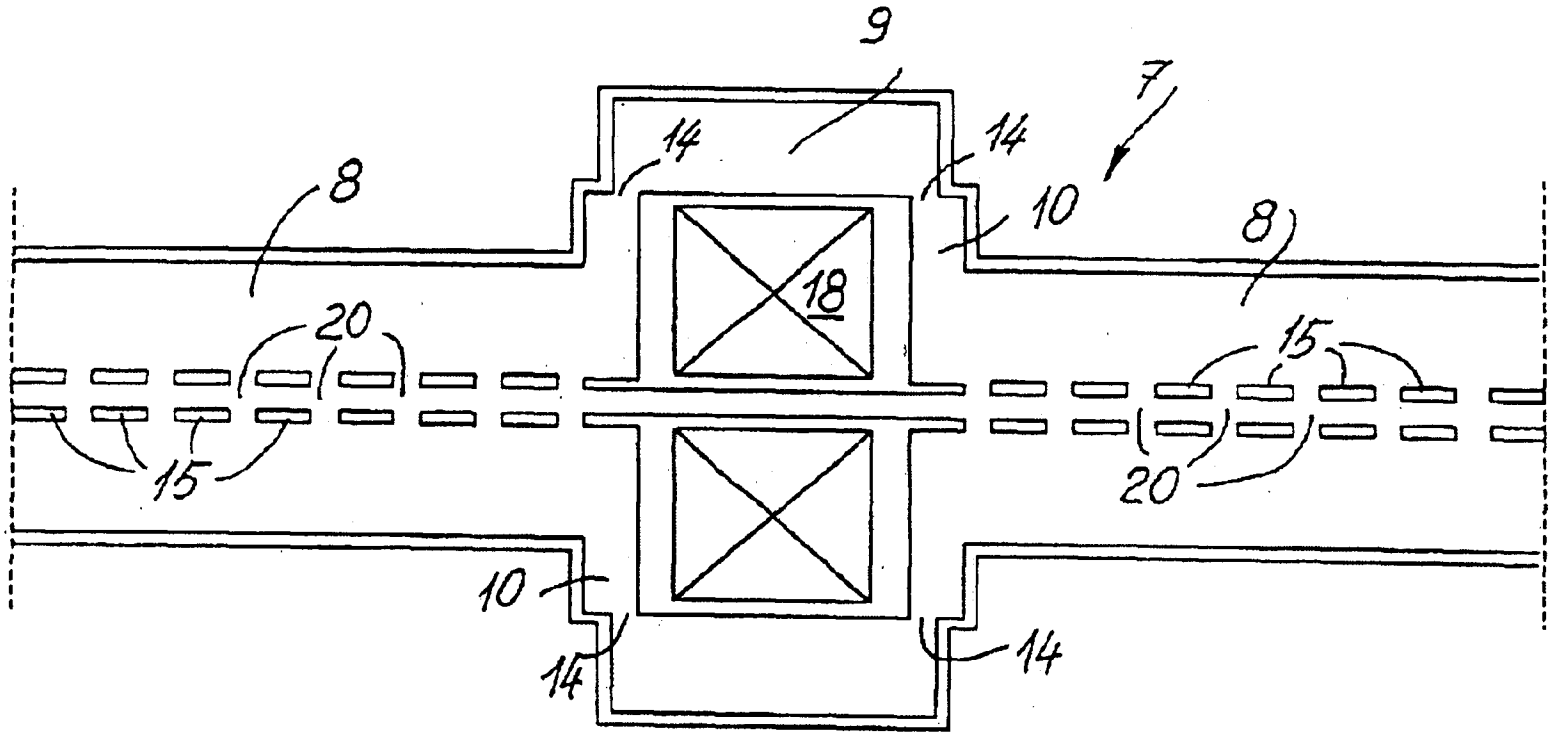
FIG. 6 is a longitudinal section of a module showing a middle coupling structure and part of two accelerating side structures, in a 45° section, FIG. 7 and in FIG. 8 show a section taken along the sectional lines VII—VII and VIII—VIII, respectively, of FIG. 4, wherein said sections are taken at the centre of the stems and show direction and orientation of the H field.

From the tri-dimensional picture of FIG. 3 are also shown three different longitudinal sections, and precisely: a horizontal section (FIG. 4), a vertical section (FIG. 5), and a 45° bent section (FIG. 6).

As can be seen from the Figures, a series of drift tubes 15, distributed along the longitudinal axis of the CLUSTER 4 is located in the accelerating structures 8. A number of m thin radial stems 16, 17 with m≧1, support, from the internal surface of the tank wall of the accelerating structures 8, each said drift tube 15. The resonant working mode of the accelerating cavities can be classified as an $H_{m10}$ mode. In the shown preferred embodiment m=2 and the stems 16, 17 are alternately horizontal 16 and vertical 17.

In other configurations with m>2 the neighbour stems 16, 17 are reciprocally rotated by π/m.

Figure 7:
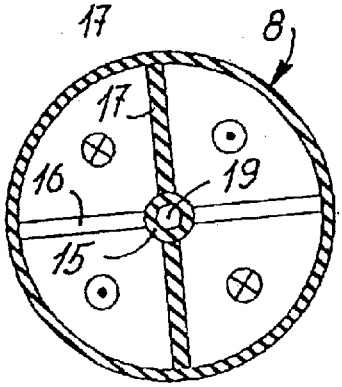
Figure 8:
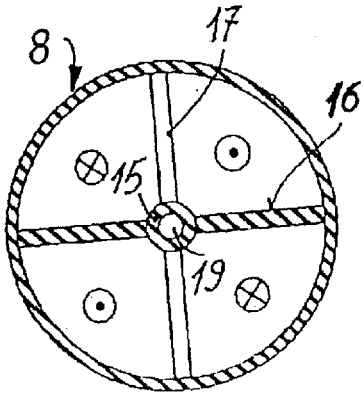

H-modes have the magnetic field disposed longitudinally along the cavity, while the electric field is radial, except on the axis where the drift tubes 15 introduce a distortion of the electric field along the beam direction F. FIGS. 7 and 8 present respectively a transverse section of the accelerating structure 8 along the sectional line VII—VII and VIII—VIII of FIG. 4 and show, according to usual conventions, the direction of the H field.

It is well known that, for an efficient acceleration, the on axis electric field should be approximately constant along the whole structure. This is not the case for the H-modes in a perfect cylindrical cavity, because the magnetic field has a maximum in the centre and a zero at the extremities of the cavity, and this brings to zero the on axis electric field at the extremities.

Some mechanical and structural modifications have therefore been added according to the invention at the terminations of the accelerating structures 8, and also at the coupling terminations 10 between accelerating structures 8 and interposed coupling structure 9, 9A to extend in the appropriate way the magnetic field lines, in order to keep roughly the same value of the electric field at each accelerating gap 20. Said terminations 10 have the additional purpose to adjust the coupling between accelerating structures 8 and the interposed coupling structure 9, 9A. To the first purpose, the length and the diameter of said terminations 10 of the accelerating structures 8 are adjusted in such a way to extend the longitudinal H-field lines close to the end caps of said accelerating structure 8. The diameter of the coupling structure 9, 9A is about twice the one of the accelerating structure 8, therefore the cylindrical terminations 10 have the shape of an annular chamber of intermediate diameter. To the second purpose, the thickness of said terminations 10, the thickness between the coupling structure 9, 9A and the terminations 10, and also the number, shape and dimensions of the coupling slots 14, are adjusted, FIGS. 3, 4, 5, 6 and 11.

Figure 9:
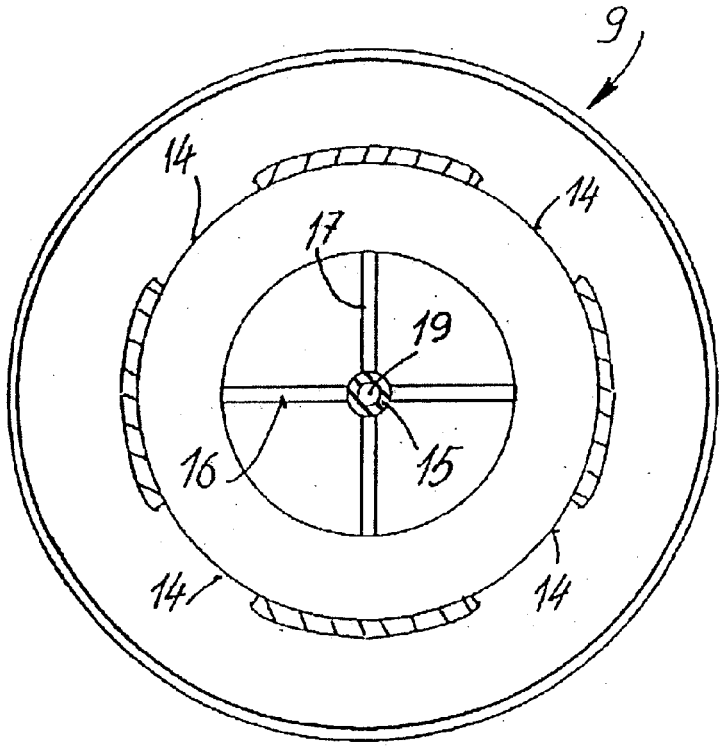
FIG. 9 and FIG. 10 illustrate sections taken along the sectional lines IX—IX and X—X, respectively, of FIG. 4.

Said terminations 10 having the shape of annular chambers are open on a circumference corresponding to their inner diameter, while on their outer surface present coupling apertures 14, FIGS. 6, 9 and 11.

Back to the accelerating structures 8, said structures can be described as an oscillating circuit that can be visualised considering for simplicity the capacitive part concentrated in the accelerating gaps 20 created between neighbour drift tubes 15, and the inductive part distributed in the remaining volume between the stems 16, 17 and the internal cavity wall, FIGS. 7 and 8. In an RF period, the path of the RF current from a drift tube 15 to the neighbour passes back and forth through a horizontal 16 and the vertical neighbours stems 17.

The working mode of the accelerating structures 8 is the $\pi$-mode, which means that, at a given time in the RF cycle, the on axis electric field direction is reversed passing from one accelerating gap 20 to the next. Effective acceleration is possible at each accelerating gap 20 because the distance between said accelerating gaps 20 is $\beta\lambda/2$. The field stability is linked to the spacing between the frequency of the working mode $\omega_0$ and the frequency of the closest (found at higher frequency) longitudinally dependent mode $\omega_1$. The dependence of $\omega_1$ from the number of accelerating gaps "ngap" per accelerating structure is described by the formula:

$$\frac{\omega_1}{\omega_0} = \sqrt{1 + \frac{1}{(ngap)^2}}$$

Since the ratio $\omega_1/\omega_0$ must not be less than a few per mil, a maximum of about 20 accelerating gaps 20 per accelerating structure 8 has been accepted.

As already mentioned, a fundamental teaching of the present invention consists in the use of a conventional H-type structure (i.e. a structure typically working at some hundreds of MHz according to conventional structures), that is made to work at high frequency, for instance, as indicated before, for deep cancer therapy.

In conventional H-mode cavities the diameter is between about 0.3 and 1 meters and the length can reach a few meters. The number of accelerating gaps between successive magnetic lenses is also about 20.

On the contrary, according to the present invention, and as can be found from the following Table 1, the length of the accelerating structures 8 does not exceed about 350 mm, reached at about $\beta$=0.6, and the diameter does not exceed about 100 mm. Since the accelerating gap length 20 decreases linearly with the frequency, while the maximum field that can be applied (according to a criterion established experimentally by Kilpatrick in 1953) increases only with about the square root of the frequency, the length of the structure for the same energy gain decreases roughly as the square root of the frequency, but more accelerating gaps 20 are required.

Since the maximum number of accelerating gaps 20 per accelerating structure 8 is about 20, the number of accelerating structures 8 to be powered is larger than in a conventional accelerator.

Moreover, direct coupling of a power line to such a small diameter structure would be extremely difficult to design, since it would be impossible to avoid severe distortions in the accelerating field. The small transverse dimensions also avoid the possibility to insert magnetic quadrupoles as focusing lenses inside the structure, as often done in the conventional cavities working at low frequency.

As explained before, these problems are efficiently solved by the novel technical and structural design of the CLUSTER 4, comprising base modules 7 and extended modules 7A. The basic structure, see for example FIG. 2, comprises two accelerating structures and one coupling structure.

Figure 10:
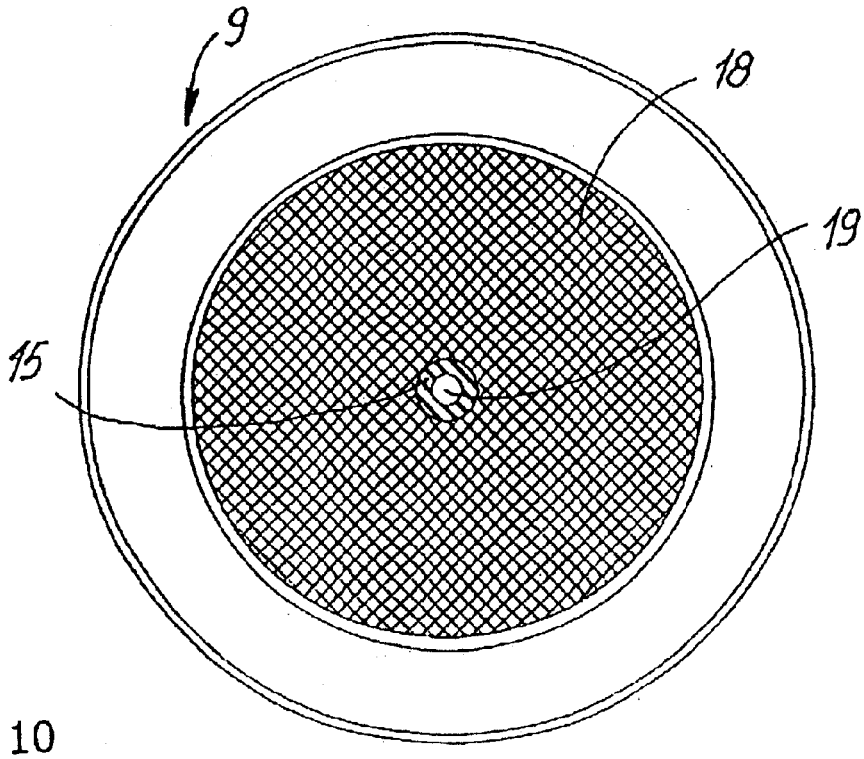

FIG. 9 shows a transverse section of the coupling structure 9, at the level of said coupling slots 14, while FIG. 10 shows a transverse section of the coupling structure 9 at the level of a magnetic quadrupole 18. As already mentioned, the coupling structure 9, 9A according to the invention in a preferred embodiment allows the housing of a small quadrupole 18 and ensures at the same time the RF coupling between all the accelerating structures of the same module 7.

In the presented embodiment, according to the invention, the quadrupoles 18, arranged inside every coupling structure 9, 9A, ensure the beam transverse focusing in the FODO lattice configuration. In practice, commercially available permanent quadrupole magnets 18 of 30 mm longitudinal length and a few mm bore radius can be used. Magnetic gradients of dB/dx≈500 T/m can be achieved.

Alternatively non-permanent quadrupoles 18 or also other functionally equivalent components can be used in CLUSTER 4 applications different from deep cancer therapy, where a lower frequency, for instance of the order of 0.6 GHz can be used.

The coupling structure 9, 9A according to the invention does not accelerate the beam and is basically a coaxial resonator oscillating on a TEM standing wave mode. Its length is such to keep the synchronism with beam acceleration. The coupling with the accelerating structures 8 is performed through two or more coupling slots 14, four in the example of FIG. 9.

Table 1 summarizes three examples of possible CLUSTER 4 modules, working at different frequencies: 1.5,3.0 and 6.0 GHz. In these examples $^{12}C^{6+}$ (Q=6, A=12) is the accelerated particle.

TABLE 1

Examples of possible CLUSTER modules to accelerate $^{12}C^{6+}$ (Q = 6, A = 12).

| | EXAMPLES OF POSSIBLE CLUSTER MODULES | | |
|---|---|---|---|
| | 1 | 2 | 3 |
| Frequency [MHz] | 1500 | 3000 | 6000 |
| Q (ion charge) | 6 | 6 | 6 |
| A (ion mass) | 12 | 12 | 12 |
| Input Energy [MeV] ($\beta_{input}$ = v/c ~ 0.25) | 360 | 360 | 360 |
| Output Energy [MeV] (0.27 ≦ $\beta_{output}$ = v/c ≦ 0.28) | 472 | 442 | 418 |
| Number of accelerating structures per module N | 4 | 4 | 4 |
| Accelerating structure length (average) [mm] | 370 | 180 | 90 |
| Accelerating structure diameter [mm] | 90 | 42 | 21 |
| Coupling structure length [mm]* | ~35 | ~35 | ~35 |
| Coupling structure diameter [mm] | 180 | 80 | 50 |
| Beam hole diameter [mm] | 10.0 | 5.0 | 2.5 |
| Overall length (module with 4 accelerating structures) [mm] | 1585 | 825 | 465 |

TABLE 1-continued

Examples of possible CLUSTER modules to accelerate $^{12}C^{6+}$ (Q = 6, A = 12).

| | EXAMPLES OF POSSIBLE CLUSTER MODULES | | |
|---|---|---|---|
| | 1 | 2 | 3 |
| Shunt impedance Z [MΩ/m] | ~100 | ~140 | ~200 |
| Average on axis field $E_0$ [MV/m] | 16.1 | 23.9 | 34.5 |
| Maximum surface field $E_{max}$ [MV/m] ($\approx 2.5 \times E_{Kilpatrick}$) | 87.5 | 117.5 | 162.5 |
| Peak power (per module of 4 accelerating structures) [MW] | 5.5 | 3.43 | 2.5 |
| Magnetic quadrupole length [mm] | 30 | 30 | 30 |
| Magnetic quadrupole gradient B' [T/m] (FODO lattice) | 210 | 355 | 475 |
| Phase advance per period σ [deg] | 80 | 74 | 50 |
| Beam minimum envelope $\beta_{min}$ [mm/mrad] | 0.3 | 0.2 | 0.2 |
| Beam maximum envelope $\beta_{max}$ [mm/mrad] | 1.6 | 0.9 | 0.6 |

*Tuned to be adapted to the quadrupole length.

From the above structural and functional description it is inferable that linacs according to the invention achieve efficiently the scope and advantages indicated and can be advantageously used in a large variety of fields, from the medical one, over which the inventors based the exposed example, to research or many other applications, for instance in high beam current production, in fission and fusion applications, and also where the use of superconducting accelerators is foreseen, and so on.

An important aspect of the present invention consists in the fact that such a linac or a CLUSTER according to the invention can also efficiently work at lower frequencies than the ones indicated. In fact, by appropriately reduction of the working frequency, for instance working with frequency of the order of 100 MHz to 0.5 GHz, it is possible to obtain higher currents, as required in many research fields. Therefore, the scope of the present invention includes all CLUSTER structures according to the invention irrespective of the number of the provided base and/or extended modules, wherein the suggested-CLUSTER can work at high as well as low frequency, as indicated above.

Those skilled in the field may introduce technically and functionally equivalent modifications in the design of linacs and CLUSTER according to the invention for various applications without departing from the scope and spirit of the present invention as defined in the accompanying claims.

Literature

P. M. Lapostolle, "Introduction à la Théorie des Accélérateurs Linéaires", CERN 87-09 Division du Synchrotron à Protons, Juillet 1987.

T. P. Wangler, "Introduction to Linear Accelerators", Los Alamos National Laboratories Report LA-UR-93-805, April 1993.

U. Ratzinger, "Effiziente Hochfrequenz-Linearbeschleuniger für leichte und schwere Ionen", Habilitationsschrift, Fachbereich Physik der Johann Wolfgang Goethe Universität, Frankfurt am Main, Juli 1998.

Inventors' past contributions to the field are listed below, ordered by publication date:

U. Amaldi, A Possible Scheme to Obtain e−e- and e+e- Collisions at Energies of Hundreds of GeV, Phys. Lett. Vol. 61B, Nr.3, pp.313–5, March 1976.

U. Amaldi, M. Grandolfo, and L. Picardi editors, "The RITA Network and the Design of Compact Proton Accelerators", INFN-LNF Frascati, Italy, August 1996 (ISBN 88-86409-08-7).

M. Crescenti and 2 co-authors, "Commissioning and Experience in Stripping, Filtering and Measuring the 4.2 MeV/u Lead Ion Beam at CERN Linac3", Linac96, Geneva, Switzerland, August 1996.

R. Zennaro and 2 co-authors, "Equivalent Lumped Circuit Study for the Field Stabilization of a Long 4-Vane RFQ", Linac98, Chicago August 1998.

M. Crescenti and 8 co-authors, "Proton-Ion Medical Machine Study (PIMMS) PART I", CERN/PS 99-010 (DI), Geneva, Switzerland, March 1999.

U. Amaldi, R. Zennaro and 14 co-authors, "Study, Construction and Test of a 3 GHz Proton Linac Booster (LIBO) for Cancer Therapy", EPAC2000, Vienna, Austria, June 2000.

U. Amaldi, R. Zennaro and 13 co-authors, "Successful High Power Test of a Proton Linac Booster (LIBO) Prototype for Hadrontherapy", PAC2000, Chicago, August 2000.

M. Crescenti and 13 co-authors, "Proton-Ion Medical Machine Study (PIMMS) PART II", CERN/PS 2000-007 (DR), Geneva, Switzerland, July 2000. In particular: Chapter II-7 Injection.

What is claimed is:

1. Linac for ion beam acceleration, characterised by the fact of comprising:

i) at least one couple of a first and a second accelerating structure (8) aligned on the same axis, resonating on a H-type standing wave electromagnetic field, each one housing a plurality of coaxial drift tubes (15), supported by stems and reciprocally separated to form a respective gap (20) accelerating the ion beam, where a first external extremity (8A) of said first accelerating structure is the input of a pre-accelerated, collimated and focused ion beam, and a second external extremity (8B) is the output of the higher energy ion beam, ii) an interposed coupling structure (9), or if necessary a modified coupling structure (9A) to be connected to an RF power generator (11), acting as a bridge for the RE power flow between adjacent accelerating structures (8), coaxial, resonating in a standing wave TEM-type cavity mode, composed of two coaxial cylinders, if necessary linked to a vacuum system (13) and including, if necessary, one or more quadrupoles (18), whose length is appropriate to maintain synchronism of the acceleration, being linked to said first and second accelerating structures (8), with their respective internal extremity (8C) through annular terminations (10), present at both extremities of said accelerating structures (8) and allowing the regulation of the electromagnetic field on the axis of each said accelerating gap (20), iii) wherein a working frequency is superior to 100 MHz.

2. Linac according to claim 1, characterised by the fact that inside said accelerating structures (8) said drift tubes (15) are supported by $m \geqq 1$ thin radial stems (16,17) reciprocally rotated on a circumference of $\pi/m$.

3. Linac according to claim 1, characterised by the fact that such annular terminations (10) are designed in the shape of annular chamber having an inner diameter corresponding to the outer diameter of said accelerating structures (8) and an outer diameter about twice the inner diameter, where said terminations in the shape of annular chamber (10) are open on a circumference corresponding to their inner diameter, while on their outer surface have coupling apertures (14) at specific positions.

4. Linac according to claim 1, characterised by the fact that the base module (7), composed of said first and second accelerating structures (8) and of said interposed coupling structure (9A), connected to an RF power generator (11), and if necessary equipped with one or more quadrupoles (18), is foreseen to be modularly extended to form extended modules (7A) comprising an always odd number n of coupling structures (9, 9A), if necessary equipped with one or more quadrupoles (18), and a number N=n+1 of accelerating structures (8).

5. Linac according to claim 1, characterised by the fact that the length of said drift tubes (15) and of said accelerating gaps (20) increases so that the distance between the centres of neighbouring said accelerating gaps (20) is about an integer multiple of the particle half wavelength ($\beta\lambda/2$).

6. Linac according to claim 1, characterised by the fact that said plurality of drift tubes (15) housed inside said accelerating structures (8) is positioned in order to determine the formation of the resonant $\pi$-mode.

7. Linac according to claim 1, characterised by the fact that each base module (7), or each said extended module (7A), forms a series of coupled resonators oscillating in the $\pi/2$ mode.

8. System of ion beam acceleration, characterised by the fact that it comprises, sequentially, an ion source (1), if necessary a pre-accelerator injector (2), if necessary a low energy beam transport line (3), a linac (4) for ion beam acceleration up to the energy required for a particular application, according to claim 1, and furthermore if necessary a high energy beam transport line (5), and an area or device (6) where the accelerated beam is used.

9. Linac according to claim 1, characterised by the fact that the working frequency is in the range 100 MHz–0.8 GHz.

10. Linac according to claim 1, characterised by the fact that the working frequency is superior to 0.8 GHz.

11. Method for accelerating an ion beam in a linac, wherein the ion beam, preliminary collimated, pre-accelerated, focused and if necessary steered in a low energy beam transport line (3), is injected into a linac (4) according to claim 1 in which:

the beam acceleration is obtained by radiofrequency electric fields whose level is substantially constant in all said accelerating gaps (20) belonging to one at least one same module (7, 7A) foreseen in the linac (4), said module presents a single input (12) for the RF power, for each module (7, 7A) foreseen, where said single input (12) for RF power is connected with a single modified coupling structure (9A), a transverse focusing is obtained with magnetic fields produced by quadrupoles (18), preferably provided between two or more accelerating structures (8), furthermore at the linac (4) output, the accelerated ion beam is if necessary steered in a higher energy beam transport line (5) in a area or to a device (6) where it is to be used.

12. Method according to claim 11, characterised by the fact that the output beam energy is modulated by varying the input RE power, and the intensity of the linac output beam is modulated by the ion beam parameters at the linac input and by the beam dynamics.

* * * * *